US009241860B2

(12) United States Patent
Palizza et al.

(10) Patent No.: US 9,241,860 B2
(45) Date of Patent: Jan. 26, 2016

(54) DEVICES AND METHODS FOR THERAPEUTIC SWINGING

(75) Inventors: Lorraine Palizza, Scarsdale, NY (US); Jeremy Gardner, Bronx, NY (US)

(73) Assignee: Southpaw Enterprises, Inc., Dayton, OH (US)

( * ) Notice: Subject to any disclaimer, the term of this patent is extended or adjusted under 35 U.S.C. 154(b) by 873 days.

(21) Appl. No.: 13/194,048

(22) Filed: Jul. 29, 2011

(65) Prior Publication Data

US 2012/0143105 A1 Jun. 7, 2012

Related U.S. Application Data

(60) Provisional application No. 61/369,316, filed on Jul. 30, 2010.

(51) Int. Cl.
*A61H 1/00* (2006.01)
*A63G 9/00* (2006.01)

(52) U.S. Cl.
CPC . *A61H 1/001* (2013.01); *A63G 9/00* (2013.01)

(58) Field of Classification Search
CPC ..... A63G 9/00; A61H 1/00
USPC ..... 601/23–24; 482/83, 85–90; 119/701–702; 472/118–119, 133, 135
See application file for complete search history.

(56) References Cited

U.S. PATENT DOCUMENTS 1,870,748 A * 8/1932 Ramey ..... 472/118
3,337,217 A * 8/1967 Cummins ..... 473/442
3,730,520 A * 5/1973 Willis ..... 472/2
4,583,617 A * 4/1986 Berger ..... 182/142
5,161,522 A * 11/1992 Clevenger ..... 601/24
5,591,208 A * 1/1997 Knutson ..... 606/241
5,611,761 A * 3/1997 Brown ..... 482/87
5,700,229 A * 12/1997 Karnofsky ..... 482/83
7,172,512 B2 * 2/2007 Be ..... 472/118
7,565,910 B2 * 7/2009 Alexakis ..... 135/117
2007/0087912 A1 * 4/2007 DeCologero ..... 482/86
2011/0077134 A1 * 3/2011 Smith ..... 482/83
2011/0079259 A1 * 4/2011 Main et al. ..... 135/116

OTHER PUBLICATIONS

Notice of Allowance mailed Sep. 15, 2011 as it relates to U.S. Appl. No. 29/366,871.

* cited by examiner

*Primary Examiner* — Justine Yu
*Assistant Examiner* — Timothy Stanis
(74) *Attorney, Agent, or Firm* — Dinsmore & Shohl LLP

(57) ABSTRACT

In one embodiment, a therapeutic swing may include a support platform, a flexible outer enclosure, a vertical bolster and a joining member. The flexible outer enclosure can be engaged with the support platform. The flexible outer enclosure may extend away from the support platform and may comprise an inner wall. The vertical bolster can be coupled to the support platform. The vertical bolster may extend away from the support platform. The vertical bolster may comprise an outer surface such that the outer surface of the vertical bolster, the inner wall of the flexible outer enclosure and the support platform cooperate to form a riding cavity. The joining member may be coupled to the vertical bolster, wherein the therapeutic swing swings from the joining member.

20 Claims, 2 Drawing Sheets

DEVICES AND METHODS FOR THERAPEUTIC SWINGING

CROSS-REFERENCE TO RELATED APPLICATIONS

This application claims the benefit of U.S. Provisional Application No. 61/369,316, filed Jul. 30, 2010, entitled "DEVICES AND METHODS FOR THERAPEUTIC SWINGING." The entire content of said application is hereby incorporated by reference.

TECHNICAL FIELD

The present invention generally relates devices and methods for therapeutic swinging.

BACKGROUND

Many children and adults may be afflicted with sensory integration dysfunction (DSI) and neurodevelopment disorders. Therapy for such persons with special needs may be conducted by therapeutic professionals, their families, and other professionals. Therefore, therapeutic products may be used by teachers in the classroom and parents at home under the guidance of a therapist. Given the wide variety of circumstances in which therapy is employed, therapeutic products may also be used during recreational time.

Accordingly, a need exists for alternative devices and methods for providing therapy.

SUMMARY

In one embodiment, a therapeutic swing may include a support platform, a flexible outer enclosure, a vertical bolster and a joining member. The flexible outer enclosure can be engaged with the support platform. The flexible outer enclosure may extend away from the support platform and may comprise an inner wall. The vertical bolster can be coupled to the support platform. The vertical bolster may extend away from the support platform. The vertical bolster may comprise an outer surface such that the outer surface of the vertical bolster, the inner wall of the flexible outer enclosure and the support platform cooperate to form a riding cavity. The joining member may be coupled to the vertical bolster, wherein the therapeutic swing swings from the joining member.

In another embodiment, a therapeutic swing may include a support platform, a flexible outer enclosure, a vertical bolster and a joining member. The support platform that can be substantially disc shaped. The vertical bolster may extend away from the support platform and be coupled to the support platform. The vertical bolster may have a substantially circular cross section. The vertical bolster may comprise a rigid core, padding, and a biologically resistant material such that the padding surrounds the rigid core and the biologically resistant material surrounds the padding. The flexible outer enclosure may be engaged with the support platform. The flexible outer enclosure may extend away from the support platform and can be concentric with the vertical bolster. The joining member can be coupled to the rigid core of the vertical bolster. A swingable cord can be coupled to the joining member and a support structure. The therapeutic swing may swing from the support structure.

In yet another embodiment, a method for therapeutic swinging may include providing a support platform for supporting a patient in opposition to gravity. Deep pressure may be applied to a chest of the patient, ribs of the patient, a stomach of the patient, a back of the patient, or combinations thereof. Vestibular and proprioceptive input may be provided to the patient contemporaneously with the deep pressure.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative in nature and not intended to limit the inventions defined by the claims. The following detailed description of the illustrative embodiments can be understood when read in conjunction with the following drawings, where like structure is indicated with like reference numerals and in which:

DETAILED DESCRIPTION

As used herein with the various illustrated embodiments described below, the following terms include, but are not limited to, the following meanings.

The phrase "removably engaged" means that components are fastened to one another via a mechanism manually engaged and disengaged such as buttons, clasps, zippers, pressure sensitive adhesive, hook and loop tape, and the like.

The term "rigid" means stiff or resistant to yielding such as wood, plastic, metal, polyvinyl chloride, and the like.

The term "padding" means a material that provides a dampening or resistive force to compression such as foam, air, cloth, and the like.

The phrase "biologically resistant material" means a material that prevents, inhibits or kills the growth of microorganisms such as protozoa, viruses, bacteria, fungi, mold, mildew, and the like.

The phrase "frictional material" means a material that is resistant to relative motion such as carpet, rubber, and the like.

The term "swing" means the movement of an object where the motion comprises displacement in the positive or negative x direction, displacement in the positive or negative y direction, displacement in the positive or negative z direction, rotation about the x axis, rotation about the y axis, rotation about the z axis, or combinations thereof.

The term "coupled" means that multiple objects are united together such as for example, bolted, welded, anchored, integral, and the like. "Coupled" may mean that the respective objects are directly joined together or the respective objects may be joined together by one or more components there between.

The term "hinge" means a coupling member that provides for motion, turning or pivoting of a first object about a second object such as a jointed device, flexible piece, a thin resilient material, and the like.

Figure 1:
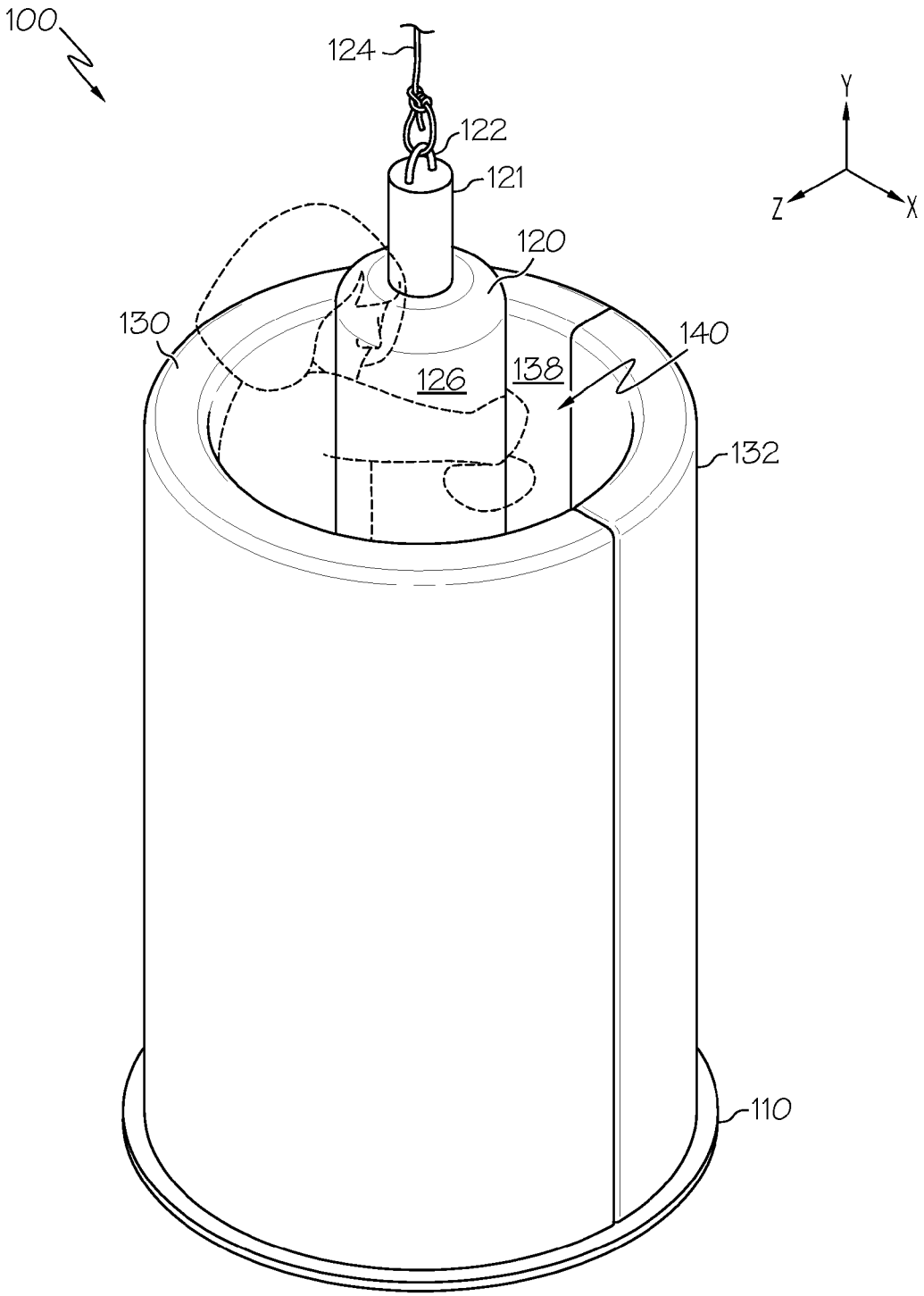
FIG. 1 depicts a perspective view vertical squeeze apparatus according to one or more embodiments shown and described herein.

FIG. 1 generally depicts one embodiment of a vertical squeeze apparatus. A vertical squeeze apparatus generally comprises a support platform, a vertical bolster, and a flexible outer enclosure. Various embodiments of the vertical squeeze apparatus and methods for providing therapeutic swinging will be described in more detail herein.

Figure 2:
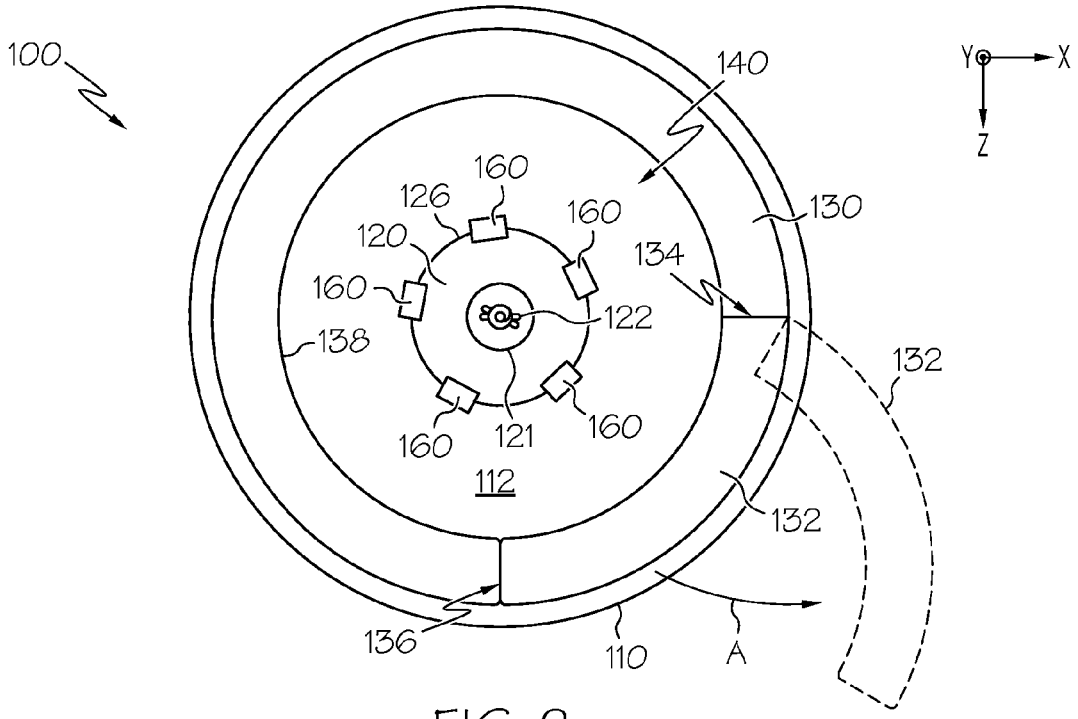
FIG. 2 depicts a top view of a vertical squeeze apparatus according to one or more embodiments shown and described herein.

Referring now to FIG. 1, a vertical squeeze apparatus 100 is schematically depicted. As will be described in more detail herein, embodiments of the vertical squeeze apparatus 100 comprise a support platform 110, a vertical bolster 120, and a flexible outer enclosure 130. The support platform 110 is coupled (e.g., bolted, welded, anchored, integral, or the like) to the vertical bolster 120, for example, using one or more coupling devices 160 (see FIG. 2), and removably engaged with the flexible outer enclosure 130. It is noted that FIGS. 1 and 2 are provided with a coordinate system. Such coordinate axes are provided herein for descriptive purposes and the embodiments described herein are not limited to any specific coordinate axis.

The support platform 110 is a structure that supports a user in opposition to gravity, which is depicted in FIG. 1 as being directed in the negative y direction. Referring again to FIG. 1, the support platform 110 comprises a substantially rigid material. While depicted in FIGS. 1 and 2 as disk shaped, the support platform 110 may be any shape such as, for example, a planar polygon or three dimensional polygon. The support platform 110 may also comprise padding, a biologically resistant material, and a frictional material. For example, in one embodiment the support platform 110 comprises a wooden core surrounded by a layer of foam with an outer covering 112 of vinyl and carpet.

The vertical bolster 120 provides a balance supporting structure and a surface that applies a deep pressure for and/or to a user of the vertical squeeze swing. In one embodiment, the vertical bolster 120 is coupled to the support platform 110, for example, using one or more coupling devices 160 (see FIG. 2), and comprises a rigid core 121 that projects vertically (depicted as the positive y direction in FIG. 1) and couples to a joining member 122 (e.g., a hook, a loop, a rope, and the like). While the rigid core 121 is depicted in FIG. 1 as protruding beyond the vertical bolster 120 in the positive y direction, it is contemplated that the rigid core 121 may be even with or recessed within the vertical bolster 120. Additionally, it is noted that the rigid core 121 and the joining member 122 may be integral. The vertical bolster 120 may also comprise padding and a biologically resistant material. For example, the vertical bolster 120 may be constructed with a rigid core 121 comprising polyvinyl chloride tubing covered by foam both wrapped with vinyl.

Still referring to FIG. 1, the flexible outer enclosure 130 provides a surface that surrounds the vertical bolster 120 to form a riding cavity 140 (see FIG. 2) and applies a deep pressure for and/or to a user of the vertical squeeze swing. In one embodiment, the flexible outer enclosure 130 is removably engaged with the support platform 110 and extends vertically. The flexible outer enclosure 130 may be any height. For example, the height may be set to about chest height for an intended user. The flexible outer enclosure 130 may also comprise padding and a biologically resistant material covering the padding. For example, flexible outer enclosure 130 may be constructed from foam that is covered with a vinyl outer layer. Furthermore, it is noted that while the flexible outer enclosure 130 is depicted as a cylinder concentric with the vertical bolster 120 having a circular cross section, the flexible outer enclosure 130 and the vertical bolster 120 may comprise any shape suitable to snugly fit a user within the riding cavity 140, as will de described in more detail herein.

Referring now to FIG. 2, the flexible outer enclosure 130 may further comprise a door 132 that provides an entry and/or exit into the riding cavity 140. The door 132 may be fabricated from flexible material(s) such that the door is flexible. In one embodiment, the door 132 comprises a pivoting side 134 and an attaching side 136. The pivoting side 134 may be rotatably coupled to the flexible outer enclosure 130 and the attaching side 136 may be removably engaged with the flexible outer enclosure 130. In one example, when closed, the pivoting side 134 is coupled to the flexible outer enclosure 130 by a hinge such as a vinyl sheet and the attaching side 136 is removably engaged with the flexible outer enclosure 130 by hook and loop tape sufficient to hold the door 132 closed when subjected to the dynamic force of a user riding the swing within the riding cavity 140. The door 132 may be rotated to the open position by releasing the hook and loop tape and pivoting about the hinge as indicated by Arrow A in FIG. 2. In another embodiment, the door 132 is removably engaged with the flexible outer enclosure 130. For example, when closed, the door 132 is removably engaged with the flexible outer enclosure 130 by hook and loop tape sufficient to hold the door 132 closed when subjected to the dynamic force of a user riding the swing within the riding cavity 140. The door 132 may be removed by releasing the hook and loop tape.

Referring again to FIG. 1, the joining member 122 may be rotatably coupled to a swingable cord 124 such as, for example, a rope or a chain. When the swingable cord 124 is coupled to and hung from a supporting structure (not depicted in FIG. 1), the vertical squeeze apparatus may swing with a user riding in the riding cavity 140. When a user rides within the vertical squeeze apparatus 100, the vestibule of the inner ear and the sensory receptors within muscles, tendons, and joints may be stimulated by the swinging.

In another embodiment, the riding cavity 140 may be configured to provide deep pressure for sensory modulation. For example, the vertical bolster 120 and/or the flexible outer enclosure 130 may be sized and shaped to snugly fit a user, i.e. a distance between the outer surface 126 of the vertical bolster 120 and the inner wall 138 of the flexible outer enclosure 130 may be about the same size as the user. Therefore, when the vertical bolster 120 and/or the flexible outer enclosure 130 comprise padding the user will be provided with a gentle compression or clamping force as shown in FIG. 1.

Figure 3:
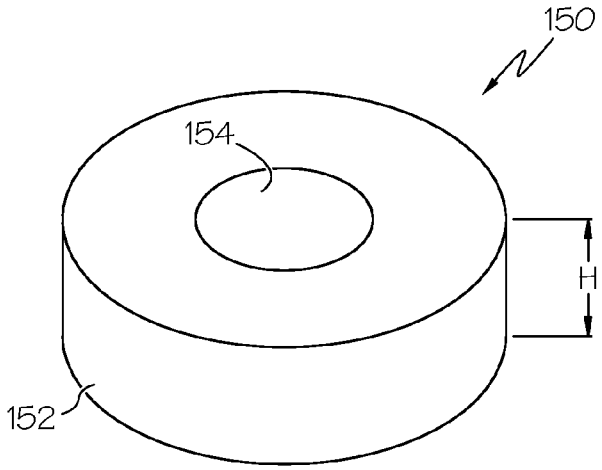
FIG. 3 depicts a perspective view of a height adjustment member according to one or more embodiments shown and described herein.

In a further embodiment, with reference to FIGS. 2 and 3 collectively, the vertical squeeze apparatus 100 comprises a height adjustment member 150 that increases the number of users who may ride within the vertical squeeze apparatus 100. The height adjustment member 150 comprises a height H, an aperture 154 and an outer engagement surface 152. The aperture 154 may be sized to frictionally fit around the vertical bolster 120 and the outer engagement surface 152 may be sized to fit within the flexible outer enclosure 130. For example, the height adjustment member 150 may be shaped like a donut with an aperture 154 having a cylindrical shape that is about the same size as the vertical bolster 120. The outer engagement surface 152 may be shaped to fit to the inner wall 138 of the flexible outer enclosure 130, i.e., the shape of the outer engagement surface 152 may correspond to the shape of the inner wall 138. The height adjustment member 150 may be slid over the vertical bolster 120 and held in place by friction and gravity. Once installed, riding cavity 140 is reduced vertically by the height H of the height adjustment member 150. In further embodiments, the height adjustment member 150 may be removably engaged with the support platform 110, the vertical bolster 120, and/or the flexible outer enclosure 130. Furthermore, it is noted that the height adjustment member 150 may comprise any of the materials described herein.

Methods for providing therapy to a patient are described herein. In one embodiment, the method comprises applying a deep pressure to a patient, applying an opposing deep pressure to the patient, providing vertical support to the patient in opposition to gravity and providing vestibular and proprioceptive input with therapeutic swinging. For example, as depicted in FIG. 1, a deep pressure may be applied to the chest, ribs or stomach of the patient by the vertical bolster 120. Simultaneously, an opposing deep pressure may be applied to the back of the patient by the flexible outer enclosure 130. Vertical support may be provided by the support platform 110. While the deep pressure, opposing pressure and vertical support is provided, the patient may be swung in order to provide full sensory modulation with a therapeutic effect. Additionally, it is noted that, while FIG. 1 depicts one patient orientation with respect to the vertical squeeze apparatus 100, the patient may be oriented in any manner with respect to the vertical squeeze apparatus 100 for therapeutic swinging while in the riding cavity 140.

It should now be understood that the devices and methods described herein provide for therapeutic swinging. For example, a child may receive vestibular and proprioceptive input along with deep pressure for sensory modulation via therapeutic swinging. Therapeutic swinging can improve balance, gross motor skills and coordination skills. The flexible outer enclosure may give a child the ability to stand in the swing while using two hands to complete various activities that increase bilateral coordination. The door allows for easy entry and exit for children of various sizes and levels of coordination. When the flexible outer enclosure is removed, the vertical squeeze apparatus may allow a child to stand on the support platform and hold onto the vertical bolster for simultaneous strength and balance therapy.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments and aspects of the present invention have been illustrated and described herein, various other changes and modifications may be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. A therapeutic swing comprising:

a support platform;

a flexible outer enclosure directly supported by the support platform, wherein the flexible outer enclosure extends away from the support platform and comprises an inner wall;

a vertical bolster disposed between the support platform and a joining member and coupled to the support platform, wherein the vertical bolster extends away from the support platform and comprises an outer surface such that the outer surface of the vertical bolster, the inner wall of the flexible outer enclosure and the support platform cooperate to form a riding cavity configured to house a patient; and the joining member coupled to the vertical bolster, wherein the therapeutic swing swings from the joining member.

2. The therapeutic swing of claim 1, further comprising a door that provides entry, exit, or both to the riding cavity.

3. The therapeutic swing of claim 2, wherein the door comprises a pivoting side rotatably engaged with the flexible outer enclosure and an attaching side removably engaged with the flexible outer enclosure.

4. The therapeutic swing of claim 2, wherein the door is removably engaged with the flexible outer enclosure.

5. The therapeutic swing of claim 1, further comprising a height adjustment member having a height wherein the height adjustment member comprises an aperture formed through the height adjustment member and the aperture frictionally fits with the vertical bolster.

6. The therapeutic swing of claim 5, wherein the height adjustment member comprises an outer engagement surface that is shaped to fit to the inner wall of the flexible outer enclosure.

7. The therapeutic swing of claim 1, wherein the support platform comprises a rigid core that is surrounded by an outer covering and the outer covering comprises a biologically resistant material, a frictional material, or both.

8. The therapeutic swing of claim 1, wherein the vertical bolster comprises a rigid core, padding, and a biologically resistant material such that the padding surrounds the rigid core and the biologically resistant material surrounds the padding.

9. The therapeutic swing of claim 8, wherein the padding comprises foam and the biologically resistant material comprises vinyl.

10. The therapeutic swing of claim 1, wherein the flexible outer enclosure is removably engaged with the support platform.

11. The therapeutic swing of claim 10, wherein the flexible outer enclosure comprises padding and a biologically resistant material such the biologically resistant material surrounds the padding.

12. The therapeutic swing of claim 1, wherein the vertical bolster and the flexible outer enclosure have a substantially circular cross section, and the flexible outer enclosure surrounds and is concentric with the vertical bolster.

13. A therapeutic swing comprising:

a support platform that is substantially disc shaped;

a vertical bolster extending away from the support platform, disposed between the support platform and a joining member, and coupled to the support platform, wherein the vertical bolster has a substantially circular cross section and comprises a rigid core, padding, and a biologically resistant material such that the padding surrounds the rigid core and the biologically resistant material surrounds the padding;

a flexible outer enclosure directly supported by the support platform, wherein the flexible outer enclosure extends away from the support platform and is concentric with the vertical bolster;

the joining member coupled to the rigid core of the vertical bolster; and a swingable cord coupled to the joining member and a support structure, wherein the therapeutic swing swings from the support structure.

14. A method for therapeutic swinging, the method comprising:

providing a support platform for supporting a patient in opposition to gravity;

applying pressure to a chest of the patient, ribs of the patient, a stomach of the patient, a back of the patient, or combinations thereof, using a vertical bolster and an outer enclosure, wherein the outer enclosure is directly supported by the support platform; and providing vestibular and proprioceptive input to the patient via swinging, wherein the vestibular and proprioceptive input is provided contemporaneously with the pressure.

15. The method of claim 14, wherein the vertical bolster comprises a rigid core, padding, and a biologically resistant material such that the padding surrounds the rigid core and the biologically resistant material surrounds the padding.

16. The method of claim 15, wherein the pressure is applied to the back of the patient by the flexible outer enclosure, simultaneous to the pressure applied by the vertical bolster.

17. The method of claim 16, wherein the vertical bolster and the flexible outer enclosure have a substantially circular cross section, and the flexible outer enclosure surrounds and is concentric with the vertical bolster.

18. The method of claim 16, wherein the flexible outer enclosure is removably engaged with the support platform.

19. The method of claim 14, wherein the pressure is applied to the back of the patient by a flexible outer enclosure, the flexible outer enclosure comprising padding and a biologically resistant material such the biologically resistant material surrounds the padding.

20. The method of claim 19, wherein the padding comprises foam and the biologically resistant material comprises vinyl.

* * * * *